US006290326B1

(12) United States Patent
Hipp et al.

(10) Patent No.: US 6,290,326 B1
(45) Date of Patent: Sep. 18, 2001

(54) ENHANCING PRINTHEAD UTILIZATION

(75) Inventors: Christian J. Hipp, Grand Island; Anthony V. Moscato, North Tonawanda, both of NY (US)

(73) Assignee: Moore North America, Inc., Grand Ilsand, NY (US)

( * ) Notice: Subject to any disclaimer, the term of this patent is extended or adjusted under 35 U.S.C. 154(b) by 0 days.

(21) Appl. No.: 09/307,783

(22) Filed: May 10, 1999

(51) Int. Cl.[7] ..... B41J 23/00; B41J 3/00; B41J 29/38; B41J 2/165

(52) U.S. Cl. ..... 347/37; 347/2; 347/16; 347/32

(58) Field of Search ..... 347/2, 14, 16, 347/19, 20, 32, 37, 41; 346/139 D

(56) References Cited

U.S. PATENT DOCUMENTS

| | | | | |
|---|---|---|---|---|
| 3,767,023 | * | 10/1973 | Effinger | 197/127 R |
| 4,227,219 | * | 10/1980 | Takemoto | 358/289 |
| 4,739,414 | * | 4/1988 | Toyono et al. | 358/296 |
| 4,878,063 | * | 10/1989 | Katerberg | 347/19 |
| 4,989,016 | * | 1/1991 | Gatten et al. | 347/2 |
| 5,124,720 | | 6/1992 | Schantz . | |
| 5,303,624 | * | 4/1994 | Ventham et al. | 83/202 |
| 5,412,410 | | 5/1995 | Rezanka | 347/15 |
| 5,530,460 | | 6/1996 | Wehl | 347/19 |
| 5,539,434 | | 7/1996 | Fuse | 347/19 |
| 5,581,284 | | 12/1996 | Hermanson | 347/43 |
| 5,640,183 | | 6/1997 | Hackleman | 347/40 |
| 5,992,962 | * | 11/1999 | Yen et al. | 347/9 |

FOREIGN PATENT DOCUMENTS

| | | | |
|---|---|---|---|
| 0 253 200 | 1/1988 | (EP) | B41J/3/20 |
| 0 566 318 A2 | 10/1993 | (EP) | B41J/2/51 |
| 11268355 | 10/1999 | (EP) | B41J/5/30 |

* cited by examiner

*Primary Examiner*—John Barlow
*Assistant Examiner*—Alfred Dudding
(74) *Attorney, Agent, or Firm*—Nixon & Vanderhye PC

(57) ABSTRACT

The effective life of a printhead, such as an ink jet printhead, is extended, when printing repetitive images, by taking measures to change the printhead print elements (e.g. nozzles) that are fired to effect repetitive imaging at a desired location on the media. The nozzles can be changed, yet the repetitive images be provided at the same desired location on the media by one or more of: finishing the media after printing to take into account a new position of the images on the media to provide a proper finished media (e.g. by trimming a particular edge or edges); at spaced points in time moving the printhead relative to the media in the second dimension (e.g. substantially transverse to the first dimension); and/or at spaced points in time moving the media in the second dimension relative to the printhead. Where the position of the printhead is moved, that may be accomplished by utilizing a detented shaft, controlled by a knob, that rotates a mounting shaft of the printhead and effects linear movement of the printhead. One detented movement of the detented shaft may correspond to a one pixel movement of the printhead.

20 Claims, 3 Drawing Sheets

ENHANCING PRINTHEAD UTILIZATION

BACKGROUND AND SUMMARY OF THE INVENTION

Ink jet printheads are useful for printing a wide variety of media (such as paper, certain plastics, cloth, etc.) in a cost effective manner. Printheads have a plurality of nozzles, and which nozzles "fire" is controlled by a computer controller to print the desired images on the media. Each of the nozzles has an effective life that is about the same on any particular printhead, and a printhead has maximum life when all of the nozzles are operated for substantially the same amount of time during the printhead's life. However, in practice when ink jet printheads are used to print repetitive images (such as lines in tables or graphs, logos, etc.) instead of variable images, some nozzles may be used essentially all of the time, and other nozzles hardly at all. This results in the printhead wearing out more quickly than desired, and in fact in extreme cases can result in the printhead no longer being effective to perform its desired function when the majority of the nozzles on the printhead is still completely operable. This problem exists with virtually all types of conventional ink jet printheads, such as (this list being exemplary only) those shown in U.S. Pat. Nos. 4,989,016, 5,640,183, 4,872,026, 4,907,018, and 5,412,410.

One way the above mentioned problem can be addressed is shown in the U.S. Pat. No. 4,989,016 (the disclosure of which is hereby incorporated by reference herein) which controls the nozzles of the ink jet printhead utilizing particular control components so as to shift the print information within acceptable tolerances within the printhead, and thereby even out the life span of the printhead when repetitive work is being performed. However, under some circumstances that technique may not be effective, or may be effective only when combined with other measures.

According to the present invention a method and system are provided which extend the effective life of a printhead when printing repetitive images by utilizing one or a number of different novel techniques to allow which nozzles are being fired to change yet not change the configuration or the position of the repetitive images being printed on the finished media being produced. Basically the techniques that are utilized are one or more of the following (which also may be used in conjunction with the technique in U.S. Pat. No. 4,989,016) when printing media moving with respect to the printhead in a first dimension, at spaced points in time moving the printhead relative to the media in a second dimension (e.g. substantially transverse to the first dimension); at spaced points in time moving the media relative to the printhead in the second dimension; and/or finishing the media after printing to take into account the nozzles that have been fired.

For the purposes of illustration this application refers to ink jet printheads, but it is understood that the principles and methods described herein can be applied equally well to extend the life of printing elements of other print devices, i.e. almost any digital imaging technology. Several digital printing devices use a plurality of individual elements to create the printed image. For example, thermal ink jet (bubble jet) printheads have a plurality of nozzles or orifices, electron beam printers use an ion cartridge with a large number of electron—beam generators, LED electrophotographic printers have arrays of LEDs, and thermal printers use arrays of resistive heating elements. All of the above mentioned printers utilize print elements that wear out with use, just like ink jets. Thus the general term "printhead" as used in this application covers ink jet, thermal ink jet, electron beam, LED, and resistive heating element, and the like, printheads.

According to one aspect of the present invention there is provided a method of printing using at least one printhead (e.g. ink jet) having a plurality of print elements (e.g. LEDs, electron beam generators, resistive heating elements, nozzles), and a media (e.g. paper, plastic sheets or webs, cloths, etc.) that is capable of receiving and holding images (e.g. ink jet) thereon, the method comprising: (a) Moving the media relative to the printhead in a first dimension. (b) Operating the printhead to fire an appropriate first set of the plurality of print elements (e.g. nozzles) thereof to print repetitive images on the media at a desired location thereon while the media is moving relative to the printhead. (c) At spaced points in time moving at least one of the media and the printhead relative to each other in a second dimension, different than the first dimension, to reposition the printhead relative to the media. And (d) in association with (c), adjusting the practice of (b) to fire an appropriate second set of the plurality of print elements (e.g. nozzles), at least some of the second set of print elements (e.g. nozzles) different than the first set, to accommodate the movement in (c) to continue to print the repetitive images on the media at the desired location thereon, so as to extend the effective life of the printhead when printing repetitive images.

In the method (c) may be practiced by moving the printhead only relative to the media, and (a)–(d) are preferably practiced so that the second dimension is substantially transverse to the first dimension. In the method (c) may be practiced to both move the printhead and the media in the second dimension, or only the media. In the method (c) there is further provided (e) at least in part finishing the media after printing to take (d) into account to insure the desired positioning of the repetitive images on the finished media, and there also may be (f) operating the print head to shift print information within acceptable tolerances within the printhead (that is changing the nozzles, etc.) only slightly so that the images and their positions are within acceptable tolerances, as disclosed in U.S. Pat. No. 4,989,016).

In the method (a)–(d) may be practiced to extend the life of some or all of the printheads by at least 10% (e.g. 20–400%) compared to if (c) and (d) were not practiced. The method (a)–(d) may be repeated once or many times depending on the width and distribution of the printing and the number of printing elements in the printhead. A typical scenario is using a 128 nozzle bubble jet ink jet printing cartridge to image one line of 8-point text. This image is approximately 40 pixels in width and is printed by a corresponding 40 nozzles of the printhead. Printing the image at the left, (nozzles 1–40), center (nozzles 42–82) and right (nozzles 84–124) of the printhead will extend the life of the printhead by three times (300%).

In the practice of the method (c) may be practiced at least in part by rotating a detented shaft to advance the shaft at least one detented position, which in turn results in substantially linear movement of the printhead a distance corresponding thereto. Also, (c) may be further practiced so that each detented position of the shaft corresponds to a one pixel substantially linear advance of the printhead, and wherein (d) is practiced to change the nozzles so that the nozzles of the second set are one pixel displaced from the first set. The detented shaft may be rotated manually or automatically.

The at least one printhead may comprise a plurality of printheads and (a)–(d) may be practiced for each of the plurality of printheads that print repetitive images. The printheads may be provided on the same mounting shaft, or different shafts. Also (d) may be practiced to fire a second set of nozzles in which substantially all of the nozzles are different than in the first set; and (c) may be practiced periodically and substantially automatically.

According to another aspect of the present invention there is provided a method of printing using at least one printhead having a plurality of print elements, and a media that is capable of receiving and holding images thereon, said method comprising: (a) Moving the media relative to the printhead in a first dimension. (b) Operating the printhead to fire an appropriate first set of the plurality of print elements thereof to print repetitive images on the media at a desired location on the finished media while the media is moving relative to the printhead. (c) At spaced points in time adjusting the practice of (b) to fire an appropriate second set of the plurality of print elements, at least some of the second set of print elements different than the first set. And (d) finishing the media after printing to take into account (c) so as to ensure that on the finished media the repetitive images are in the desired position, so as to extend the effective life of the printhead when printing repetitive images. In the practice of this aspect of the invention typically the media should be wider than it otherwise would be, so that the finishing equipment can trim various amounts from the different edges thereof to produce a final finished media of the desired configuration.

According to another aspect of the present invention there is provided a system which extends the life of a printhead printing repetitive images. The system may comprise the following components: At least one printhead (e.g. ink jet) having a plurality of print elements (e.g. nozzles). A media that is movable relative to the printhead, and is capable of receiving and holding images (e.g. ink jet) thereon. Means for moving the media relative to the printhead in a first dimension. Means for operating the printhead to fire an appropriate first set of the plurality of print elements thereof to print repetitive images on the media at a desired location thereon. And means for at spaced times moving at least one of the media and the printhead relative to each other in a second dimension, different than the first dimension, to reposition the printhead relative to the media. And wherein the means for operating the printhead is adjusted to fire an appropriate second set of the plurality of print elements different than the first set to accommodate the second dimension movement to continue to print the repetitive images on the media at the desired location thereon, so as to extend the effective life of the printhead (e.g. at least 10%, preferably 20–400% and all narrower ranges within that broad range) when printing repetitive images.

The second dimension moving means may comprise means for moving the printhead, and the second dimension may be substantially transverse to the first dimension. In a preferred embodiment the second dimension moving means comprises a lead screw shaft, a traveling nut mounting the printhead on the lead screw shaft; and a detented shaft connected to the lead screw shaft, rotation of the detented shaft effecting substantially linear movement of the printhead. In the system each detented position of the detented shaft may correspond to substantially linear movement of the printhead one pixel. A knob may be connected to the detented shaft for effecting manual rotation of the detented shaft, or the shaft may be rotated automatically, e.g. by a stepper motor or the like.

It is the primary object of the present invention to provide for the effective utilization of substantially the entire width of a printhead (e.g. ink jet), avoiding the situation where some print elements (e.g. nozzles) are completely worn out while other print elements have a significant part (and sometimes even the majority) of their useful life remaining. This and other objects of the invention will become clear from an inspection of the detailed description, and from the appended claims.

DETAILED DESCRIPTION OF THE DRAWINGS

Figure 1:
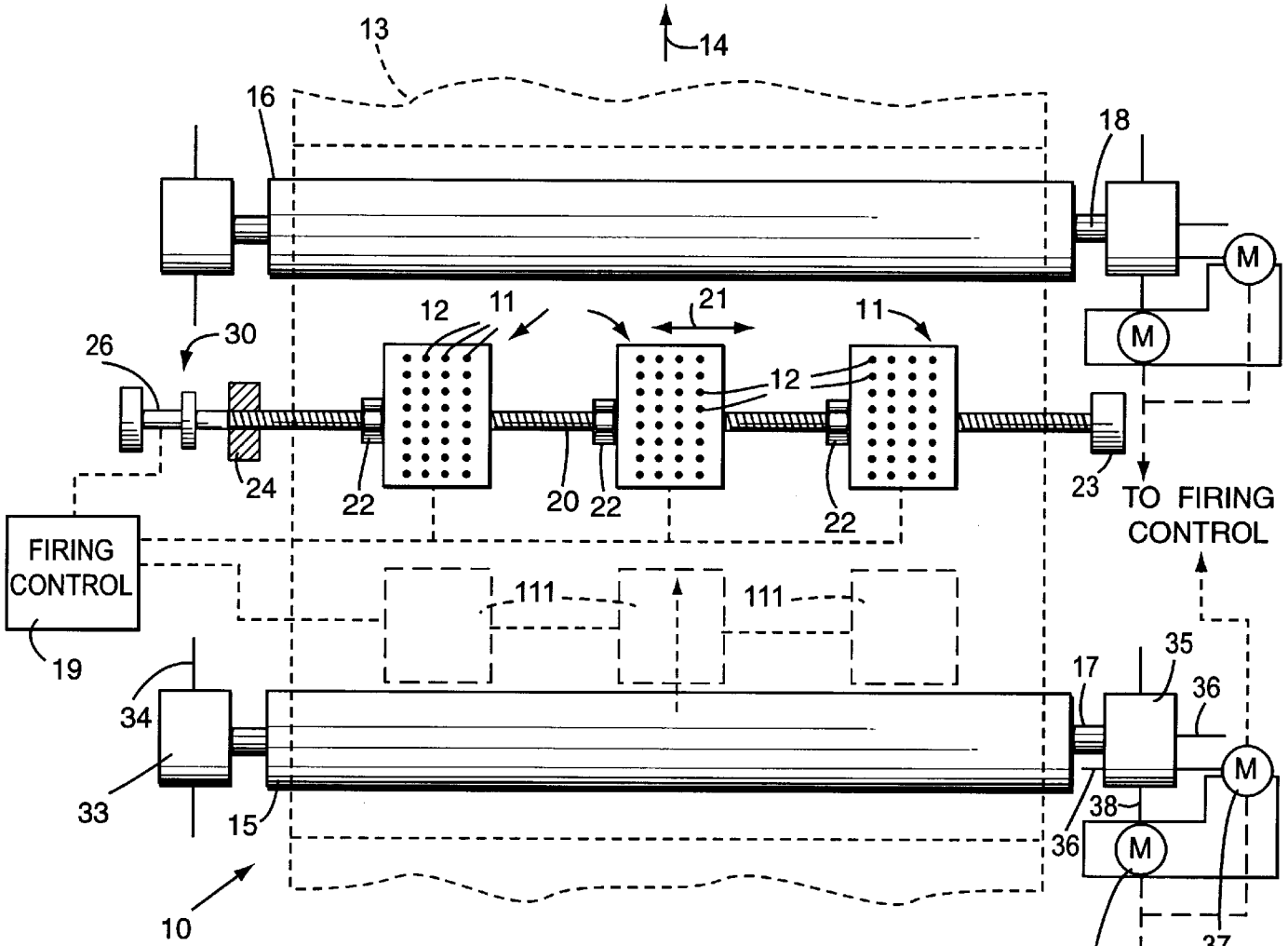
FIG. 1 is a schematic view showing an exemplary system for practicing the method of printing using at least one printhead, so as to extend the effective life of the printhead when printing repetitive images, according to the present invention.

FIG. 1 illustrates, schematically, a system 10 which may be utilized in a method of printing using ink jet printheads according to the present invention, so as to extend the effective life of the printheads when printing repetitive images. The system 10 includes at least one conventional printhead 11 (e.g. an ink jet printhead) having a plurality of print elements (e.g. nozzles) 12. The printheads 11 are shown only schematically in FIG. 1 and may be of any suitable type, such as in U.S. Pat. Nos. 4,989,016, 5,640,183, the other patents mentioned above, or any other suitable conventional printheads, including thermal ink jet, electron beam, LED, and resistive heating.

Figure 3:
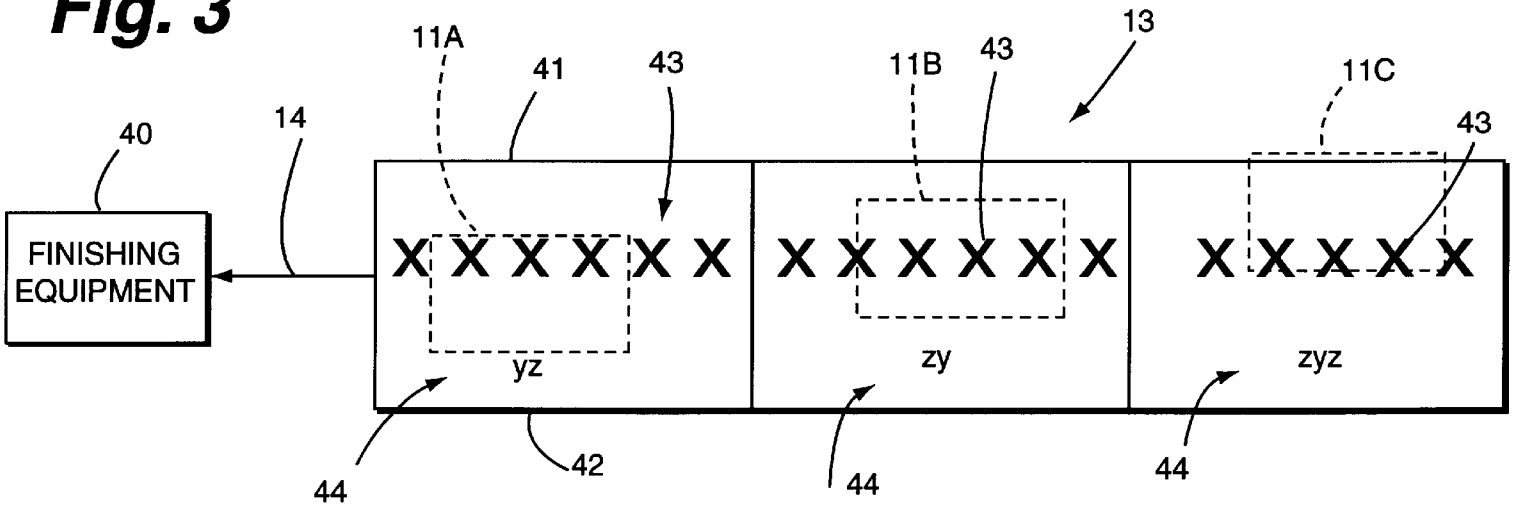
FIG. 3 is a schematic view illustrating relative movement of the printhead with respect to the media that results in a uniform finished media product according to the invention.
Figure 4A:
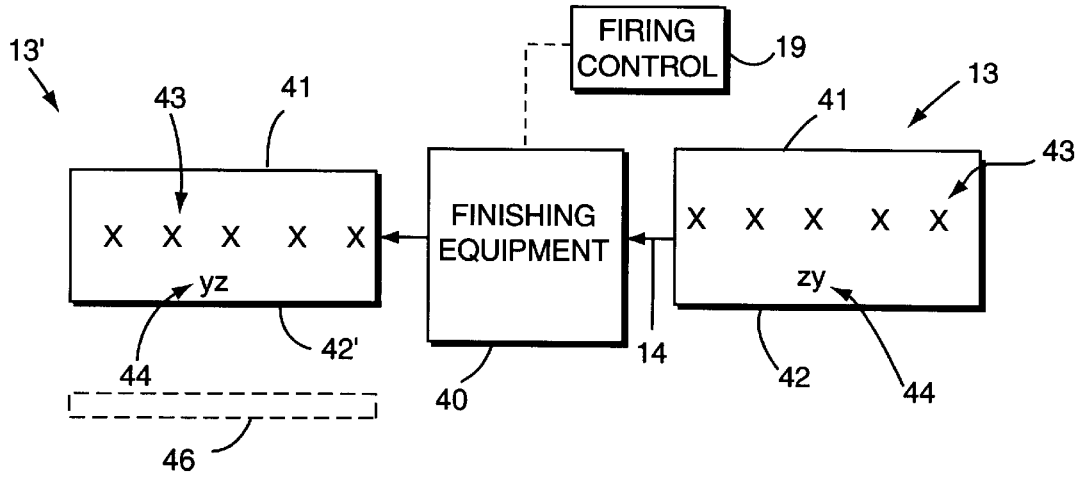
FIGS. 4A and 4B are views like that of FIG. 3 only showing how the utilization of finishing equipment may be employed to produce a desired finished product when the nozzles, or other print elements, in the printhead supplying the repetitive images are changed.
Figure 4B:
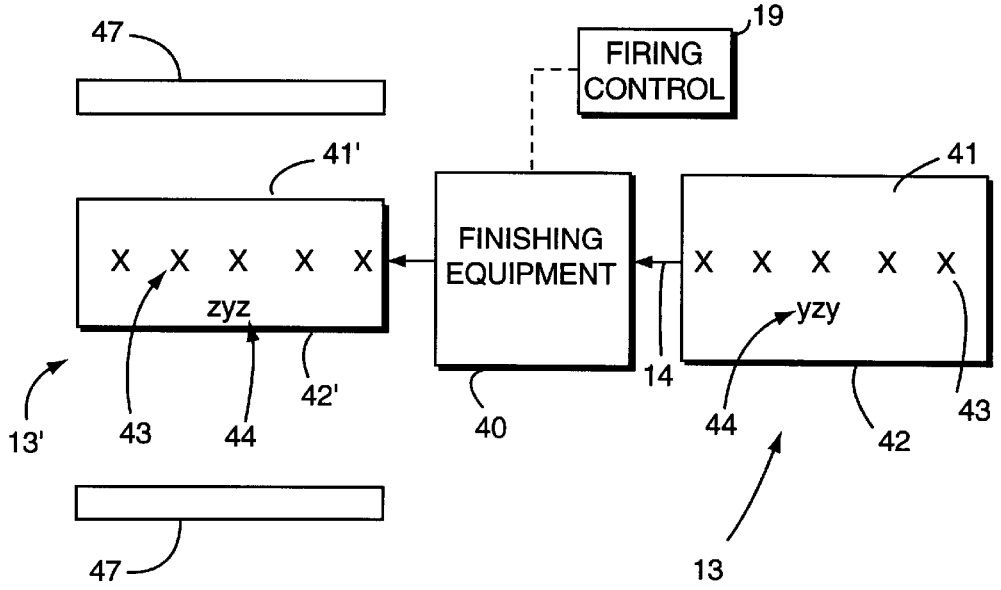

The system also includes media—shown in dotted line at 13 in FIG. 1 so that the rest of the components can be clearly seen, but shown in solid line at 13 in FIGS. 3, 4A, 4B—which is printed on. The media 13 may be any suitable conventional media (such as paper, a number of plastics, cloth, or the like) in web or sheet form which is capable of receiving and holding images (e.g. ink jet images) thereon.

During operation of the system 10, the media 13 is moved relative to the printheads 11 in a first dimension, indicated by arrow 14. Any suitable conventional equipment may be utilized to effect this movement. Movement may be continuous, incremental, or otherwise. Examples of conventional means for moving the media 13 include rollers, tenter frames, belts, tapes, and combinations thereof. In the exemplary (only) embodiment illustrated in FIG. 1 such means include a first roller 15 upstream of the printheads 11, and a second roller 16 downstream of the printheads 11, in a direction 14. Both rollers are rotatable about shafts 17, 18, respectively, mounted by bearings at opposite ends thereof, with at least one powered.

Which print elements (e.g. nozzles) 12 in the printheads 11 will be fired at any particular point in time is controlled by conventional firing control 19, which may be any suitable conventional controller, typically a computer, which receives information about the images to be applied by the printheads 11 to the media 13.

In many situations one or more of the printheads 11 are mounted on a shaft 20. In a preferred embodiment according to the invention the positions of the printheads 11 on the shaft 20, and/or the positions of the printheads 11 with respect to the media 13 in general, is adjustable in a second dimension 21 which is different than the first dimension 14. While the second dimension 21 is shown as substantially perpendicular to the first dimension 14 (which is preferred) it is to be understood that the second dimension 21 can be at almost an angle with the respect to the dimension 14, or at least between 20 and 160°. In the exemplary (only) embodiment illustrated in FIG. 1, the mounting shaft 20 is a lead screw and the printheads 11 are mounted to the lead screw 20 by conventional traveling nuts 22 so that rotation of the lead screw 20 results in substantially linear movement of the printheads 11 in the dimension 21. Guide rods, or like accessory guiding devices, may be also be provided to insure that the movement in dimension 21 is as desired. The lead screw 20 is mounted at one end thereof by a conventional bearing 23, and adjacent the other end by another conventional bearing 24.

According to the present invention, the lead screw 20 may be precisely rotated a desired rotation angle so as to result in substantially linear movement in the dimension 21 of the printhead 11 a desired amount. This desired amount may be substantially one pixel. In order to allow such precise movement the mechanism illustrated in FIGS. 1 and 2, and most clearly in FIG. 2, may be provided.

Figure 2:
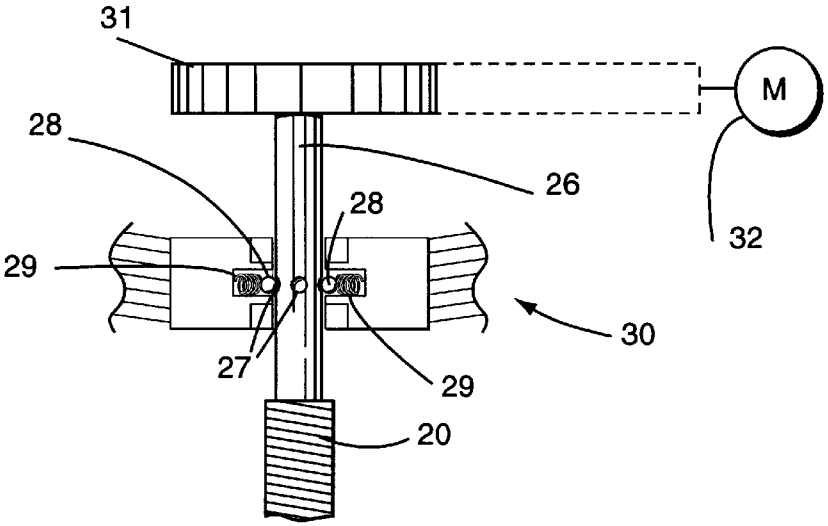
FIG. 2 is a detailed schematic side view of a component of an exemplary system according to the present invention which allows precise desired movement of the printhead relative to the media in a dimension different than the normal dimension of the media movement with respect to the printhead.

The mechanism illustrated in FIG. 2 comprises a detented shaft 26. See the detents 27 thereon, which preferably cooperate with detent balls 28, pressed by springs 29, which are dimensioned to engage the detents 27 in the shaft 26. The detented shaft 26 is connected to (e.g. integral with or is welded to) the lead screw 20, and the entire detent mechanism—shown generally by reference numeral 30 in FIGS. 1 and 2—is fixed relative to the shaft 26. The shaft 26 may be rotated between the detented positions by a manual knob 31, or by any suitable powered device, such as a conventional stepper motor, a pneumatic cylinder, etc., illustrated merely schematically at 32 in FIG. 2.

The rotation of the shaft 26 one detented position (e.g. corresponding to a one pixel movement of the printheads 11 in the dimension 21) is sensed by the firing control 19 by any suitable conventional sensing mechanism, such as a magnet and Reed switch, optical sensor, etc. When the information about rotation of the detented shaft 26 is provided to the firing controller 19, the controller 19 changes which of the nozzles 12 of the printheads 11 will be fired to print repetitive data so that the data is printed at substantially the same desired position on the member 13.

Please note that FIGS. 1 and 2 are schematic illustrations only, and the relative dimensions of the shaft 26, positions of the printheads 11, etc. may be changed widely to accommodate any particular situation and the particular equipment utilized.

FIG. 1 also schematically illustrates means which are capable of moving the position of the traveling media 13 in the second dimension 21 relative to the printheads 11. Any suitable conventional structures may be provided for that purpose, such as conventional tracks, pneumatic or hydraulic cylinders, x-y coordinate systems, or the like. In the exemplary (only) embodiment illustrated, the roller 15, shaft 17 is mounted by a bearing 33 at the left end thereof as seen in FIG. 1, the bearing 33 allowing movement of the shaft 17 with respect thereto in the dimension 21, and the bearing 33 optionally being mounted on a track 34 that extends along the dimension 14. At the opposite end of the shaft 17 a bearing 35 is provided which also may comprise a conventional motor for rotating the roller 15 if it is a drive component of the means for moving the media 13 in the dimension 14. The bearing or motor 35 is preferably mounted for movement on a track 36 extending in the dimension 21, and a cylinder, stepper motor, or the like 37 is provided for moving the bearing 35 along the track 36 to thereby change the position of the roller 15 in the second dimension 21, and thereby the position of the media 13. Similar components are shown for the roller 16, but not described herein since they are identical. Under some circumstances, depending upon the frictional forces and other factors, only the position of the roller 15 need be moved in the dimension 21, not the position of the roller 16.

While not necessary, under some circumstances it may be desirable to also move the rollers 15, 16 in the dimension 14, and for this purpose the additional track 38 and cylinder or stepper motor 39 may be provided.

The system 10 may also comprise—as illustrated in FIG. 3 and FIGS. 4A and 4B—finishing equipment, shown generally by reference numeral 40. The finishing equipment 40 typically trims the side edges of the media 13, such as the edges 41, 42 illustrated in FIGS. 3, 4A, and 4B. The finishing equipment may be any conventional equipment capable of trimming the edges 41, 42 or otherwise acting on the media 13, whether in web or sheet form.

In the practice of one aspect of the method according to the present invention, there is provided: (a) Moving (e.g. substantially continuously, incrementally, etc.) the media 13 relative to the printhead 11 in the first dimension 14 (e.g. by utilizing the rollers 15, 16 or other conventional equipment for advancing the web or sheet of the media 13). (b) Operating the printhead 11 to fire an appropriate first set of the plurality of nozzles 12 to print repetitive images on the media 13 at a desired location thereon while the media is moving relative to the printhead, the operation being provided by the conventional firing control 19. The repetitive images that are printed are shown schematically by the lines "X" at 43 in FIGS. 3, 4A, and 4B. In a normal situation other ink jet printheads—such as shown schematically in dotted line at 111 in FIG. 1—are provided to also print variable data on the media 13, the variable data (shown in different characters in different places to indicate the variable nature thereof, as contrasted with the repetitive images 43) is shown by reference numerals 44 in FIGS. 3, 4A, and 4B. While what the images 43, 44 are can be varied almost infinitely within any particular situation, oftentimes the repetitive images 43 are things like lines for graphs or tables, logos which appear on each sheet of the media 13 or at each predetermined space corresponding to a length of a final sheet produced of the web of the media 13, etc. The variable images 44 are typically alphanumeric characters, such as people's names, addresses, account numbers, etc.

The method further comprises (c) at spaced points in time (such as periodically after a certain number or amount of the repetitive images 43 have been formed, or after the passage of a predetermined amount of time) moving at least one of the media 13 and the printhead 11 relative to each other in the second dimension 21 to reposition the printhead 11 relative to the media 13. For example, this may be accomplished by rotating the shaft 26 one detented position to thereby substantially linearly move the printhead 11 in the dimension 21 one pixel (or any other predetermined amount), and/or by using the stepper motor or cylinder 37 to move the roller 15 (and the media 13 engaging it) a desired amount in the dimension 21. This relative movement is schematically illustrated in FIG. 3 which shows, in dotted line, the printhead 11 in a position 11A where a certain set of nozzles 12 thereof print the repetitive images 43, and a second position 11B where others of the nozzles 12 print the repetitive images 43 in the same relative position to the edges 41, 42, of the media 13, and the position 11C where still other sets of nozzles 12 of the printhead 11 print the repetitive images 43 at the desired relative location with respect to the edges 41, 42.

That is, FIG. 3 schematically illustrates procedure (d) of the method, wherein, in association with (c) the practice of (b) is adjusted to fire an appropriate second set of the plurality of nozzles 12, at least some of the second set of nozzles (and preferably substantially all of the second set of nozzles) being different than the first set, to accommodate the movement in (c), to continue to print the repetitive images 43 on the media 13 at the desired location thereon (as illustrated in FIG. 3). These method operations thus extend the effective life of the printhead. For example, (a)–(d) may be practiced to extend the life of some or all of the printheads 11 by at least 10% (e.g. 20–400%) compared to if (c) and (d) were not practiced. The method (a)–(d) may be repeated once or many times depending on the width and distribution of the printing and the number of printing elements in each printhead 11. A typical scenario is using a 128 nozzle bubble jet ink jet printing cartridge to image one line of 8-point text. This image is approximately 40 pixels in width and is printed by a corresponding 40 nozzles 12 of the printhead 11. Printing the image at the left, (nozzles 1–40), center (nozzles 42–82) and right (nozzles 84–124) of the printhead 11 will extend the life of the printhead by three times (300%).

In the method (c) may be practiced substantially automatically, or manually, and in response to any stimuli or position of components. Also, the method may further comprise (e) operating the printhead 11 (using the firing control 19) to shift print information within acceptable tolerances within the printhead 11, especially where the tolerances for the repetitive images 43 with respect to the edges 41, 42 are not too tight. This feature may be practiced in conjunction with either of the other provisions set forth in (c).

Additionally, or alternatively, the method may comprise finishing the media 13 (with the finishing equipment 40) so as to insure that on the finished media 13 the repetitive images 43 are in the desired position. This aspect of the invention is seen by a comparison of FIGS. 4A and 4B. FIG. 4A shows the media 13 prior to the finishing equipment 40, and the finished media 13' after the equipment 40. To produce the media 13 that is illustrated in FIG. 4A a certain set of nozzles 12 of the printhead 11 were fired. The finishing equipment 40—in conjunction with data provided by the finishing control 19 which tells where the repetitive images 43 have been provided on the media 13, or additionally or alternatively using sensors (such as optical or magnetic sensors) of conventional construction to sense the repetitive images 43 just prior to the finishing equipment 40—the finishing equipment 40 trims the side edge 42 to produce the side edge 42' (removing the trimmed piece 46) so that the repetitive images 43 are in the desired location with respect to the edges 41, 42'. The same concept may be utilized for cutting a web which comprises the media 13 to insure proper positioning of the repetitive images 43 in the dimension 14.

FIG. 4B then illustrates the situation where the firing control 19 has changed what nozzles are fired to print the repetitive images 43. Note that in this situation the images 43 have a different location visàvis the side edges 41, 42 than in FIG. 4A. The finishing equipment 40 takes this different positioning into account, and trims both edges 41', 42' a desired amount (trimming off both pieces 47) so that the finished media 13' in FIG. 4B is exactly the same (within the tolerances provided) as the media 13' in FIG. 4A; that is the repetitive images 43 are in their proper location with respect to the side edges of the media 13'.

The finishing equipment 40 may always trim both edges 41, 42, or just one of the edges, depending upon the particular requirements involved, to achieve the desired positioning of the repetitive images 43, as well as to accomplish other objectives (such as removing tractor holes, providing crisp edges as opposed to uneven ones, etc.).

In the practice of the invention, the various method steps or operations may be repeated in sequence (any desired sequence) over any particular period of time that can optimize operation of the printhead 11. The goal is to have substantially all of the nozzles 12 of the printhead 11 be used for their entire effective life before the printhead needs to be replaced. The invention is particularly useful with ink jet printheads that do not have a predetermined capacity of ink associated with them, but rather are filled continuously, but is also utilized with printheads where the ink reservoir is large or the ink reservoir is periodically recharged, or with LED, resistive heating element, and electron beam printheads.

While certain ranges and dimensions are given in the description of the preferred embodiment, it is to be understood that other dimensions and ranges may be provided, as well as all narrower ranges within any broad range being specifically provided herein, in order to accomplish the ultimate objective of extending printhead life compared to the situation where no special care is taken to change the print elements being used to print repetitive images.

While the invention has been herein shown and described in what is presently conceived to be the most practical and preferred embodiment thereof, it will be apparent to those of ordinary skill in the art may be made thereof within the scope of the invention, which scope is to be accorded the broadest interpretation of the appended claims so as to encompass all equivalent methods and systems.

What is claimed is:

1. A method of printing using at least one printhead having a plurality of print elements, and a media that is capable of receiving and holding images thereon, said method comprising:

(a) moving the media relative to the printhead in a first dimension;

(b) operating the printhead to fire an appropriate first set of the plurality of print elements thereof to print repetitive images on the media at a plurality of desired locations thereon while the media is moving relative to the printhead;

(c) at spaced points in time moving at least one of the media and the printhead relative to each other in a second dimension, different than the first dimension, to reposition the printhead relative to the media; and (d) in association with (c), adjusting the practice of (b) to fire an appropriate second set of the plurality of print elements, at least some of the second set of print elements different than the first set, to accommodate the movement in (c) to continue to print the repetitive images on the media at the desired location thereon, so as to extend the effective life of the printhead when printing repetitive images.

2. A method as recited in claim 1 wherein (c) is practiced by moving the printhead only relative to the media.

3. A method as recited in claim 2 wherein (a)–(d) are practiced so that the second dimension is substantially transverse to the first dimension.

4. A method as recited in claim 1 wherein (c) is practiced to both move the printhead and the media in the second dimension.

5. A method as recited in claim 1 further comprising (e) at least in part finishing the media after printing to trim one or both edges thereof substantially parallel to said first direction to take (d) into account to insure the desired positioning of the repetitive images on the finished media.

6. A method as recited in claim 1 wherein (c) is practiced at least in part by rotating a detented shaft to advance the shaft at least one detented position, which in turn results in substantially linear movement of the printhead a distance corresponding thereto.

7. A method as recited in claim 1 wherein the at least one printhead comprises a plurality of printheads; and wherein (a)–(d) are practiced for each of the plurality of printheads printing repetitive images.

8. A method as recited in claim 1 wherein (a)–(d) are practiced so that the second dimension is substantially transverse to the first dimension.

9. A method as recited in claim 1 wherein (d) is practiced to fire a second set of print elements in which substantially all of the print elements are different than in the first set.

10. A method as recited in claim 1 wherein (c) is practiced periodically and substantially automatically.

11. A method as recited in claim 1 further comprising (e) operating the printhead to shift print information within acceptable tolerances within the printhead.

12. A method of printing using at least one printhead having a plurality of print elements, and a media that is capable of receiving and holding images thereon, said method comprising:

(a) moving the media relative to the printhead in a first dimension;

(b) operating the printhead to fire an appropriate first set of the plurality of print elements thereof to print repetitive images on the media at a desired location thereon while the media is moving relative to the printhead;

(c)at spaced points in time moving at least onr of the media and the printed relative to each other in a second dimension, different than the first dimension, to reposition the printhead relative to the media; and (d) in association with (c), adjusting the practice of (b) to fire an appropriate second set of the plurality of print elements, at least some of the second set of print elements different than the first set, to accommodate the movement in (c) to continue to print the repetitive images on the media at the desired location thereon, so as to extend the effective life of the printhead when printing repetitive images;

wherein (a)–(d) are practiced to extend the effective life of at least some printheads by at least 10% compared to if (c) and (d) were not practiced.

13. A method of printing using at least one printhead having a plurality of print elements, and a media that is capable of receiving and holding images thereon, said method comprising:

(a) moving the media relative to the printhead in a first dimension;

(b) operating the printhead to fire an appropriate first set of the plurality of print elements thereof to print repetitive images on the media at a desired location thereon while the media is moving relative to the printhead;

(c) at spaced points in time moving at least one of the media and the printhead relative to each other in a second dimension, different than the first dimension, to reposition the printhead relative to the media, wherein (c) is practiced at least in part by rotating a detented shaft to advance the shaft at least one detented position, which in turn results in substantially linear movement of the printhead a distance corresponding thereto; and (d) in association with (c), adjusting the practice of (b) to fire an appropriate second set of the plurality of print elements, at least some of the second set of print elements different than the first set, to accommodate the movement in (c) to continue to print the repetitive images on the media at the desired location thereon, so as to extend the effective life of the printhead when printing repetitive images;

wherein (c) is further practiced so that each detented position of the shaft corresponds to a one pixel substantially linear advance of the printhead, and wherein (d) is practiced to change the print elements so that the print elements of the second set are one pixel displaced from the first set.

14. A method of printing using at least one printhead having a plurality of print elements, and a media that is capable of receiving and holding images thereon, said method comprising:

(a) moving the media relative to the printhead in a first dimension;

(b) operating the printhead to fire an appropriate first set of the plurality of print elements thereof to print repetitive images on the media at a desired location thereon while the media is moving relative to the printhead;

(c) at spaced points in time moving at least one of the media and the printhead relative to each other in a second dimension, different than the first dimension, to reposition the printhead relative to the media; and (d) in association with (c), adjusting the practice of (b) to fire an appropriate second set of the plurality of print elements, at least some of the second set of print elements different than the first set, to accommodate the movement in (c) to continue to print the repetitive images on the media at the desired location thereon, so as to extend the effective life of the printhead when printing repetitive images;

wherein (a)–(d) are practiced so that the second dimension is substantially transverse to the first dimension;

wherein the printheads are ink jet printheads, and the print elements nozzles and wherein (c) is practiced at least in part by rotating a detented shaft to advance the shaft at least one detented position, which in turn results in substantially linear movement of the printhead a distance corresponding thereto; and wherein (c) is further practiced so that each detented position of the shaft corresponds to a one pixel substantially linear advance of the printhead, and wherein (d) is practiced to change the nozzles so that the nozzles of the second set are one pixel displaced from the first set.

15. A method of printing using at least one printhead having a plurality of print elements, and a media that is capable of receiving and holding images thereon, said method comprising:

(a) moving the media relative to the printhead in a first dimension;

(b) operating the printhead to fire an appropriate first set of the plurality of print elements thereof to print repetitive images on the media at a plurality of desired locations on the finished media while the media is moving relative to the printhead;

(c) at spaced points in time adjusting the practice of (b) to fire an appropriate second set of the plurality of print elements, at least some of the second set of print elements different than the first set; and (d) finishing the media after printing to take into account (c) so as to ensure that on the finished media the repetitive images are in the desired position, so as to extend the effective life of the printhead when printing repetitive images by at least 20% compared to if (c) and (d) were not practiced.

16. A system which extends the life of a printhead printing repetitive images, comprising:

at least one printhead having a plurality of print elements;

a media that is movable relative to the printhead, and is capable of receiving and holding images thereon;

means for moving the media relative to the printhead in a first dimension;

means for operating the printhead to fire an appropriate first set of the plurality of print elements thereof to print repetitive images on the media at a desired location thereon; and means for at spaced times moving at least one of the media and the printhead relative to each other in a second dimension, different than the first dimension, to reposition said printhead relative to said media; and wherein said means for operating said printhead is adjusted to fire an appropriate second set of said plurality of print elements different than said first set to accommodate said second dimension movement to continue to print the repetitive images on said media at the desired location thereon, so as to extend the effective life of said printhead when printing repetitive images.

17. A system as recited in claim 16 wherein said second dimension moving means comprises means for moving said printhead; and wherein said second dimension is substantially transverse to said first dimension.

18. A system as recited in claim 17 wherein said second dimension moving means comprises a lead screw shaft, a traveling nut mounting said printhead on said lead screw shaft; and a detented shaft connected to said lead screw shaft, rotation of said detented shaft effecting substantially linear movement of said printhead.

19. A system as recited in claim 18 further comprising a knob connected to said detented shaft for effecting manual rotation of said detented shaft.

20. A system which extends the life of a printhead printing repetitive images, comprising:

at least one printhead having a plurality of print elements;

a media that is movable relative to the printhead, and is capable of receiving and holding images thereon;

means for moving the media relative to the printhead in a first dimension;

means for operating the printhead to fire an appropriate first set of the plurality of print elements thereof to print repetitive images on the media at a desired location thereon; and means for at spaced times moving at least one of the media and the printhead relative to each other in a second dimension, different than the first dimension, to reposition said printhead relative to said media; and wherein said means for operating said printhead is adjusted to fire an appropriate second set of said plurality of print elements different than said first set to accommodate said second dimension movement to continue to print the repetitive images on said media at the desired location thereon, so as to extend the effective life of said printhead when printing repetitive images;

wherein said second dimension moving means comprises means for moving said printhead; and wherein said second dimension is substantially transverse to said first dimension;

wherein said second dimension moving means comprises a lead screw shaft, a traveling nut mounting said printhead on said lead screw shaft; and a detented shaft connected to said lead screw shaft, rotation of said detented shaft effecting substantially linear movement of said printhead;

wherein each detented position of said detented shaft corresponds to substantially linear movement of said printhead one pixel.

* * * * *